US008919252B2

(12) United States Patent
Lestrange et al.

(10) Patent No.: US 8,919,252 B2
(45) Date of Patent: Dec. 30, 2014

(54) METHODS AND SYSTEMS FOR INK-BASED DIGITAL PRINTING WITH MULTI-COMPONENT, MULTI-FUNCTIONAL FOUNTAIN SOLUTION

(75) Inventors: Jack Lestrange, Macedon, NY (US); Santokh S. Badesha, Pittsford, NY (US); Mandakini Kanungo, Penfield, NY (US); David J. Gervasi, Pittsford, NY (US); Maryna Ornatska, Hightstown, NJ (US); Matthew M. Kelly, West Henrietta, NY (US)

(73) Assignee: Xerox Corporation, Norwalk, CT (US)

( * ) Notice: Subject to any disclaimer, the term of this patent is extended or adjusted under 35 U.S.C. 154(b) by 160 days.

(21) Appl. No.: 13/601,803

(22) Filed: Aug. 31, 2012

(65) Prior Publication Data

US 2014/0060356 A1 Mar. 6, 2014

(51) Int. Cl.

| | |
|---|---|
| ***B41N 3/08*** | (2006.01) |
| ***B41F 1/18*** | (2006.01) |
| ***B41M 1/06*** | (2006.01) |

(52) U.S. Cl.

USPC ..... 101/478; 101/483

(58) Field of Classification Search

CPC .... B41C 1/105; B41C 1/1075; B41C 1/1041; B41C 1/1033; B41C 1/1008; B41C 1/10; B41C 2210/08; B41M 1/06; B41F 33/0054; B41F 1/18; G03F 7/18; G03F 7/16; B41N 3/006; B41N 3/08; B41P 2227/70; C09D 183/08; C09D 4/00; C23C 2222/20

USPC ..... 101/478, 450.1, 401.1, 483; 430/300; 106/287.11

See application file for complete search history.

(56) References Cited

U.S. PATENT DOCUMENTS

| | | | |
|---|---|---|---|
| 3,741,118 | A | 6/1973 | Carley |
| 3,800,699 | A | 4/1974 | Carley |

(Continued)

FOREIGN PATENT DOCUMENTS

| | | | |
|---|---|---|---|
| DE | 101 60 734 | A1 | 7/2002 |
| DE | 103 60 108 | A1 | 10/2004 |

(Continued)

OTHER PUBLICATIONS

European Search Report in corresponding related application EP 11 187 196.8 dated Mar. 30, 2012.

(Continued)

*Primary Examiner* — Matthew G Marini
*Assistant Examiner* — Leo T Hinze
(74) *Attorney, Agent, or Firm* — Ronald E. Prass, Jr.; Prass LLP

(57) ABSTRACT

An Ink-based digital printing system comprises an external fluid applicator for applying multi-component, multi-functional fountain solution to a surface of an imaging plate. The plate is image wise exposed using a high power laser to remove primary components of the fountain solution from select regions of the plate according to digital image data, leaving a layer of the secondary components at said select regions. The plate is then inked with ink useful in printing. The ink adheres to the select regions from which the primary components have been removed to form an ink image. The ink image is transferred at an image transfer step wherein the secondary components enable efficient transfer of the ink to a medium with reduced image quality defects. The multi-component fountain solution comprises primary components that reject or repel ink, and secondary components that function as a release agent.

11 Claims, 4 Drawing Sheets

(56) References Cited

U.S. PATENT DOCUMENTS

| | | | | |
|---|---|---|---|---|
| 3,877,372 | A | 4/1975 | Leeds | |
| 4,234,443 | A | 11/1980 | Canale et al. | |
| 4,627,349 | A | 12/1986 | Claussen | |
| 4,887,528 | A | 12/1989 | Ruge et al. | |
| 5,067,404 | A | 11/1991 | Frunder et al. | |
| 5,695,550 | A | 12/1997 | Marx et al. | |
| 5,701,815 | A | 12/1997 | Bocko et al. | |
| 5,855,173 | A | 1/1999 | Chatterjee et al. | |
| 6,125,756 | A | 10/2000 | Nüssel et al. | |
| 6,146,798 | A | 11/2000 | Bringans et al. | |
| 6,318,264 | B1 | 11/2001 | D'Heureuse et al. | |
| 6,725,777 | B2 | 4/2004 | Katano | |
| 6,841,366 | B1 | 1/2005 | Bower et al. | |
| 7,020,355 | B2 | 3/2006 | Lahann et al. | |
| 7,061,513 | B2 | 6/2006 | Katano et al. | |
| 7,100,503 | B2 | 9/2006 | Wiedemer et al. | |
| 7,191,705 | B2 | 3/2007 | Berg et al. | |
| 7,887,981 | B2 * | 2/2011 | Inagaki et al. | 430/66 |
| 8,256,346 | B2 * | 9/2012 | Lewis et al. | 101/450.1 |
| 8,347,787 | B1 | 1/2013 | Stowe et al. | |
| 2003/0167950 | A1 | 9/2003 | Mori | |
| 2004/0011234 | A1 | 1/2004 | Figov et al. | |
| 2004/0182270 | A1 * | 9/2004 | Wiedemer et al. | 101/465 |
| 2005/0178281 | A1 * | 8/2005 | Berg et al. | 101/463.1 |
| 2005/0258136 | A1 | 11/2005 | Kawanishi et al. | |
| 2006/0152566 | A1 | 7/2006 | Taniuchi et al. | |
| 2007/0199457 | A1 | 8/2007 | Cyman, Jr. et al. | |
| 2007/0199458 | A1 | 8/2007 | Cyman, Jr. et al. | |
| 2007/0199459 | A1 | 8/2007 | Cyman, Jr. et al. | |
| 2007/0199460 | A1 | 8/2007 | Cyman, Jr. et al. | |
| 2007/0199461 | A1 | 8/2007 | Cyman, Jr. et al. | |
| 2007/0199462 | A1 | 8/2007 | Cyman, Jr. et al. | |
| 2008/0011177 | A1 | 1/2008 | Muraoka | |
| 2008/0032072 | A1 | 2/2008 | Taniuchi et al. | |
| 2008/0223240 | A1 | 9/2008 | Drury et al. | |
| 2010/0031838 | A1 | 2/2010 | Lewis et al. | |
| 2012/0103212 | A1 | 5/2012 | Stowe et al. | |
| 2012/0103213 | A1 | 5/2012 | Stowe et al. | |
| 2012/0103214 | A1 | 5/2012 | Stowe et al. | |
| 2012/0103217 | A1 | 5/2012 | Stowe et al. | |
| 2012/0103218 | A1 | 5/2012 | Stowe et al. | |
| 2012/0103219 | A1 | 5/2012 | Stowe et al. | |
| 2012/0103221 | A1 | 5/2012 | Stowe et al. | |
| 2012/0274914 | A1 | 11/2012 | Stowe et al. | |
| 2013/0032050 | A1 | 2/2013 | Pattekar et al. | |
| 2013/0033686 | A1 | 2/2013 | Stowe et al. | |
| 2013/0033687 | A1 | 2/2013 | Stowe et al. | |
| 2013/0033688 | A1 | 2/2013 | Stowe et al. | |

FOREIGN PATENT DOCUMENTS

| | | | |
|---|---|---|---|
| DE | 10 2006 050744 | A1 | 4/2008 |
| DE | 10 2008 062741 | A1 | 7/2010 |
| EP | 1 935 640 | A2 | 6/2008 |
| EP | 1 938 987 | A2 | 7/2008 |
| EP | 1 964 678 | A2 | 9/2008 |
| EP | 2450190 | A1 | 5/2012 |
| EP | 2586622 | A2 | 5/2013 |
| WO | 2006/133024 | A2 | 12/2006 |
| WO | 2009/025821 | A1 | 2/2009 |

OTHER PUBLICATIONS

European Search Report in corresponding related application EP 11 187 195.0 dated Mar. 28, 2012.
European Search Report in corresponding related application EP 11 187 193.5 dated Feb. 29, 2012.
European Search Report in corresponding related application EP 11 187 192.7 dated Feb. 28, 2012.
European Search Report in corresponding related application EP 11 187 191.9 dated Mar. 1, 2012.
European Search Report in corresponding related application EP 11 187 190.1 dated Mar. 12, 2012.
European Search Report in corresponding related application EP 11 187 189.3 dated Feb. 28, 2012.
Shen et al., "A new understanding on the mechanism of fountain solution in the prevention of ink transfer to the non-image area in conventional offset lithography", J. Adhesion Sci. Technol., vol. 18, No. 15-16, pp. 1861-1887 (2004).
Katano et al., "The New Printing System Using the Materials of Reversible Change of Wettability", International Congress of Imaging Science 2002, Tokyo, pp. 297 et seq. (2002).
Biegelsen, U.S. Appl. No. 13/366,947, filed Feb. 6, 2012.
Liu et al., U.S. Appl. No. 13/426,209, filed Mar. 21, 2012.
Liu et al., U.S. Appl. No. 13/426,262, filed Mar. 21, 2012.
Hsieh, U.S. Appl. No. 13/601,817, filed Aug. 31, 2012.
Hsieh et al., U.S. Appl. No. 13/601,840, filed Aug. 31, 2012.
Kelly et al., U.S. Appl. No. 13/601,854, filed Aug. 31, 2012.
Liu, U.S. Appl. No. 13/601,876, filed Aug. 31, 2012.
Kanungo et al., U.S. Appl. No. 13/601,892, filed Aug. 31, 2012.
Moorlag et al., U.S. Appl. No. 13/601,905, filed Aug. 31, 2012.
Gervasi et al., U.S. Appl. No. 13/601,920, filed Aug. 31, 2012.
Gervasi et al., U.S. Appl. No. 13/601,938, filed Aug. 31, 2012.
Gervasi et al., U.S. Appl. No. 13/601,956, filed Aug. 31, 2012.
Kanungo et al., U.S. Appl. No. 13/601,962, filed Aug. 31, 2012.
European Search Report in corresponding European Patent Application No. 13181454.3 mailed Feb. 13, 2014.

* cited by examiner

METHODS AND SYSTEMS FOR INK-BASED DIGITAL PRINTING WITH MULTI-COMPONENT, MULTI-FUNCTIONAL FOUNTAIN SOLUTION

RELATED APPLICATIONS

The disclosure is related to U.S. patent application Ser. No. 13/095,714, filed on Apr. 27, 2011, titled "Variable Data Lithography System", the disclosure of which is incorporated herein by reference in its entirety.

FIELD OF DISCLOSURE

The disclosure relates to ink-based digital printing. In particular, the disclosure relates to methods and systems for ink-based digital printing with a multi-component, multi-functional fountain solution.

BACKGROUND

A digital ink-based printing system may be used for printing with typical printing inks. Digital ink-based printing processes may include applying fountain solution to a surface of an imaging plate. The imaging plate may be arranged on an outer portion of an imaging cylinder. The imaging cylinder may rotatable for bringing regions of the imaging plate surface to pass adjacent subsystems, including: a dampener for applying fountain solution; a laser for imaging or image-wise vaporization of fountain solution from select regions of the imaging plate; an inker for applying ink to the imaging plate surface; a transfer station from which an ink image is transferred to a printable medium; and a cleaner for removing residue from a surface of the image plate and preparing the surface to begin the process anew. After applying the fountain solution, a high power laser may be used to image-wise vaporize fountain solution from select regions of the surface. The laser may be used to for vaporizing the fountain solution at select surface regions in accordance with digital image data. Ink may be applied by the inker, and may be deposited on regions where fountain solution has been vaporized from the imaging plate. Conversely, ink may be rejected by regions of the imaging plate surface where fountain solution remains. A resulting image is transferred at the transfer station to paper or other suitable media by way of pressure.

The efficiency of ink release from a surface of the imaging plate for transfer to a printable medium such as paper is dependent on presence of an ink release agent on, or in a surface of the imaging plate. For example, the bulk of a silicone imaging plate may include free silicone oil which acts as an ink release agent during the ink transfer step. Because there is a finite amount of free silicone oil in the imaging plate's bulk, ink transfer efficiency will degrade as the silicone oil reserves are depleted. Free silicone oil can be replenished via an external Release Oil Management system. However, a release oil management system adds additional cost and complexity along with potential failure modes associated with release agent layer uniformity.

SUMMARY

Fountain solution having both ink rejecting and ink release components, and systems configured for applying said fountain solution for ink-based digital printing are desired. In an embodiment, a digital ink based printing system may include an imaging plate; an external fluid applicator configured to apply multi-component fountain solution to a surface of the imaging plate for ink-based digital printing.

Systems may include the multi-component fountain solution comprising primary, ink rejecting components and secondary, ink release agent components, the primary components having a boiling point that is lower than the secondary components. The primary components may comprise octamethylcyclotetrasiloxane. The secondary components may comprise amino silicone fluid. The primary components and the secondary components may be miscible and may form a temporally stable solution. The fountain solution may comprise a 0.1% to 10% by volume mixture of amino silicone oil to octamethylcyclotetrasiloxane. In an embodiment, the imaging plate may comprise silicone. For example, the plate may be formed of silicone based elastomers. The silicone plate may include an outer layer comprising rubber and/or fluorohydropolymer elastomers such as VITONs.

In an embodiment, methods may include ink-based digital printing, comprising of the application of a fountain solution to a surface of an imaging plate, the fountain solution comprising ink rejecting primary components and release agent secondary components; exposing the surface of the imaging plate by laser imaging whereby the primary components are removed from portions of the surface of the imaging plate according to imaging data, leaving a layer of the secondary components on a surface of the imaging plate; applying ink to the surface of the imaging plate in the regions where laser evaporation of the primary components has occurred to form an ink image, the ink being rejected by the primary components at portions of the surface of the imaging plate having the both primary & secondary components after the exposing. Methods may include transferring the ink image to a printable substrate, whereby the second component layer splits.

In an embodiment, methods may include primary components comprising octamethylcyclotetrasiloxane. Methods may include secondary components comprising functional silicone release fluids e.g. amino, mercapto, hydro, etc. Methods may include the fountain solution comprising a 0.1 to 10% by volume mixture of silicone release fluid to octamethylcyclotetrasiloxane. Methods may include the ink being useful for digital ink-based printing.

In an embodiment, methods may include laser vaporization of the primary components to remove the primary components from the portions of the surface of the imaging plate according to digital image data. Methods may include mixing octamethylcyclotetrasiloxane and amino silicone oil to produce the fountain solution.

In an embodiment, a fountain solution useful for ink-based printing using digital architecture printing may include primary components; and secondary components, the primary components having a lower boiling point than the secondary components. In an embodiment, the primary components may comprise octamethylcyclotetrasiloxane. The secondary components may comprise amino silicone oils. The primary components and the secondary components are miscible, and the solution may include the secondary components being in an amount of 0.1% to 1% by volume in the octamethylcylotetrasiloxane.

Exemplary embodiments are described herein. It is envisioned, however, that any system that incorporates features of apparatus and systems described herein are encompassed by the scope and spirit of the exemplary embodiments.

DETAILED DESCRIPTION

Figure 1:
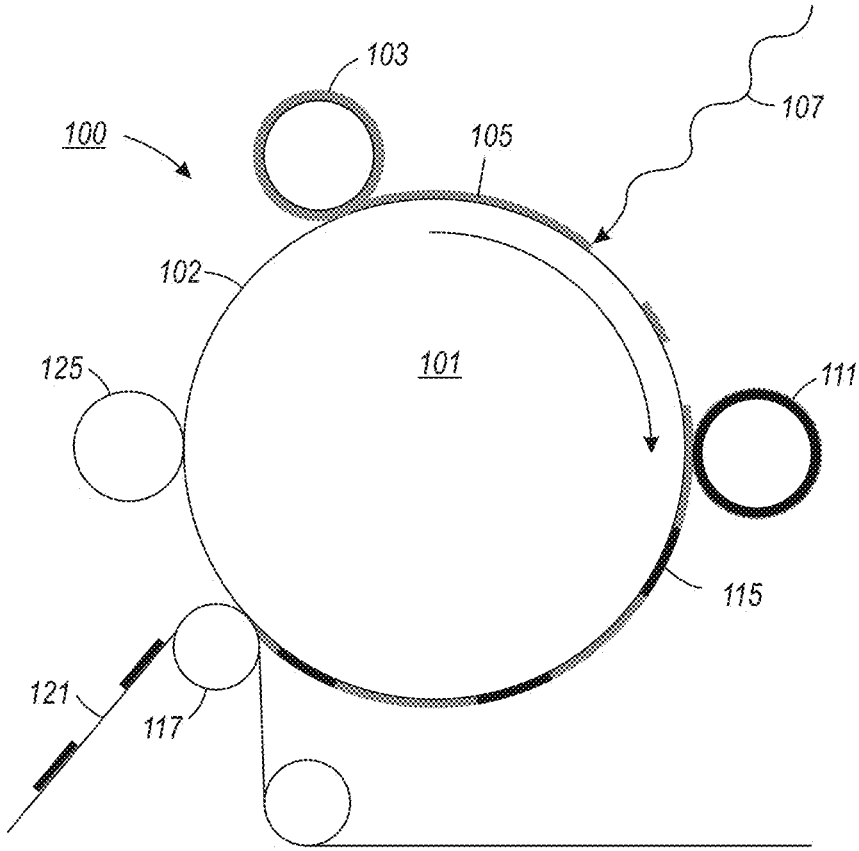
FIG. 1 shows a diagrammatical view of digital architecture printing system and processes.

Exemplary embodiments are intended to cover all alternatives, modifications, and equivalents as may be included within the spirit and scope of the apparatus and systems as described herein.

Reference is made to the drawings to accommodate understanding of methods and systems for ink-based digital printing using multi-component, multi-functional fountain solution. In the drawings, like reference numerals are used throughout to designate similar or identical elements. The drawings depict various embodiments and data related to embodiments of illustrative methods and systems for ink-based digital printing using multi-component, multi-functional fountain solution.

A digital architecture printing system may be used for digital ink-based printing. FIG. 1 shows a digital architecture printing system 100 for printing on media such as paper with printing ink. System 100 may include an imaging member such as cylinder 101. The imaging cylinder 101 may include an imaging plate 102 formed on an outer portion of the cylinder 101. The plate may be formed of silicone, and may be configured to absorb light energy. The plate may include an outer layer comprising rubber and fluoropolymer elastomer such as VITON.

The imaging cylinder 101 may rotatable for bringing regions of the imaging plate 102 surface to pass adjacent subsystems, including: a dampener or fountain solution application system 103 for applying fountain solution 105; an imaging laser (not shown) for image-wise vaporization of fountain solution 105 from select regions 107 of the imaging plate 102; an inker 111 for applying ink 115 to the imaging plate 102 surface; a transfer station 117 from which an ink image is transferred to a printable medium 121; and a cleaner 125 for removing residue from a surface of the imaging plate 102 and preparing the imaging plate 102 surface for beginning the process anew.

Ink-based digital printing processes may include applying multi-component, multi-functional fountain solution containing ink rejector components and release agent components to a surface of an imaging plate 102 using a metering system or dampener. After applying the fountain solution 105, a high power laser may be used to image-wise vaporize the ink rejecting components of the fountain solution from select regions 107 of the surface, leaving behind the release agent components. Ink 115 may be applied by the inker 111, and may adhere to regions where ink rejecting components of the fountain solution 105 has been vaporized from the imaging plate 102. Conversely, ink 115 may be rejected by regions of the imaging plate surface where ink rejecting components of the fountain solution remain after the vaporizing. A resulting image is transferred at the transfer station 117 to paper or other suitable media by way of pressure.

An efficiency of ink release from a surface of the imaging plate for transfer to a printable medium such as paper is dependent on presence of an ink release agent on, or in a surface of, the imaging plate. For example, in related art systems, the bulk of the silicone imaging plate may include free silicone oil, which acts as an ink release agent during the ink transfer step. However, because there is a finite amount of free silicone oil in the imaging plate's bulk, ink transfer efficiency degrades as the silicone oil reserves are depleted. Free silicone oil can be replenished via an external Release Oil Management (RAM) system. The drawbacks of a release oil management system are additional cost and complexity along with potential failure modes associated with release agent layer uniformity.

It has been found that readily available fluid, D4-Siloxane, or octamethylcyclotetrasiloxane, demonstrates effective ink rejection. D4-Siloxane is a cost-effective alternative to other ink rejection fluids. Similarities in chemical properties of the imaging plate 102, which may be a silicone imaging plate, and D4-Siloxane allow for absorption into the bulk of the plate 102 whereby the plate is caused to swell significantly. Although imaging plate materials such as VITON have been found to be resistant to swelling caused by D4-Siloxane, they have high surface energies and lack free fluid in their bulk to act as an ink release agent. Ink release efficiency for such materials has been found to be unacceptably low, e.g., about 50%.

Methods and systems use a fountain solution comprising at least two components: 1) primary components having effective ink rejection properties and a relatively low boiling point, allowing the primary components to substantially vaporize during an imaging or vaporizing step of the ink-based digital printing processes; and 2) secondary or lower concentration components having effective ink release properties and a relatively high boiling point, allowing the secondary components to remain on an imaging plate surface after the vaporizing step. After the vaporizing step, a thin film of release agent will remain on select imaged regions of the imaging plate. In an inking step, an inker applies ink to the imaging plate, which adheres to regions of the imaging plate surface from which the primary components of the fountain solution have been vaporized, and is rejected from the select imaged regions of the imaging plate surface on which the ink rejecting primary component remains. The release agent serves as a splitting medium that enables efficient ink transfer to media.

Figure 2A:
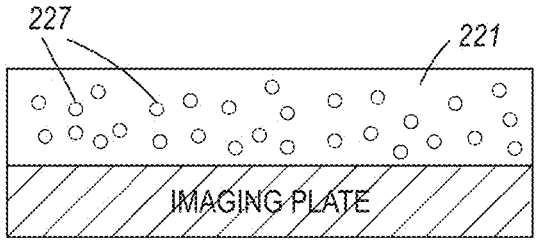
FIG. 2A shows a side diagrammatical cross-sectional view of an imaging plate in a pre-imaging step of a digital lithographic printing process.

FIGS. 2A-2D shows an embodiment of methods by way of diagrammatical cross-sectional side views. FIG. 2A shows an imaging plate having fountain solution applied thereon. The fountain solution includes primary components 221, which are ink rejectors. A suitable ink rejecting primary component may comprise D4 octamethylcyclotetrasiloxane. The fountain solution includes secondary components 227, which are release agents. A suitable release agent may comprise amino silicone oil. Although the primary components 221 and the secondary components 227 are depicted as being in suspension, the components are miscible, and combine to form a temporally stable mixture in a fountain solution mixing step. The fountain solution may be applied in a fountain solution applying step wherein fountain solution is applied to a surface of the imaging plate by an external fluid applicator. FIG. 2A shows the imaging plate and fountain solution in a pre-imaging step after the fountain solution has been applied to the plate surface in a fountain solution application step.

Figure 2B:
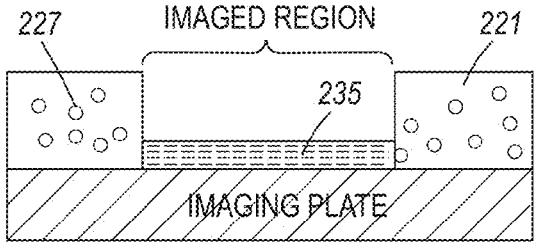
FIG. 2B shows a side diagrammatical cross-sectional view of an imaging plate in a post-imaging step of a digital lithographic printing process.

FIG. 2B shows an imaging plate after an imaging or vaporizing step in which a high power laser is used to evaporate select regions of an imaging plate surface. Post-imaging or vaporizing, an ink release agent film 235 remains at the select plate surface regions. Specifically, ink rejector 221 is removed and release agent 227 remains at the select regions, while the multi-component mixture comprising primary components 221 and the release agents 227 remain at any other regions to which no laser has been applied.

Figure 2C:
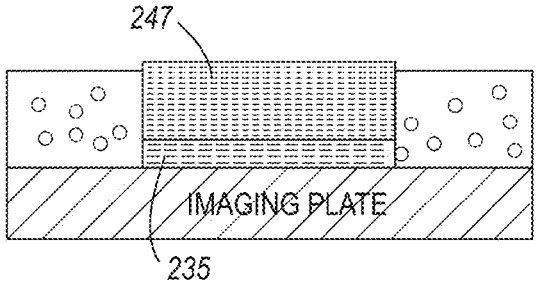
FIG. 2C shows a side diagrammatical cross-sectional view of an imaging plate in a post-inking step of an ink-based digital printing process.
Figure 2D:
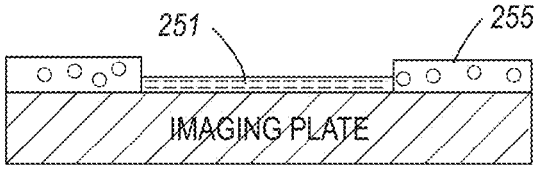

FIG. 2C shows an imaging plate after an inking step at an inking subsystem. The ink 247 is shown adhered to the release agent film comprising the secondary components. After inking, substantially no ink remains at portions having remaining multi-component fountain solution. FIG. 2D shows the imaging plate after a transfer step wherein the ink is transferred to media such as paper at a transfer station. The ink release layer enables splitting of the ink release layer enabling efficient transfer of the ink to paper. Some fountain solution may also be transferred to the paper.

Fountain solution in accordance with embodiments may include primary components comprising D4 or octamethylcyclotetrasiloxane, and an amino silicone oil secondary component. D4 has been found to effectively reject ink for use in digital printing, is readily available, and cost-effective. Amino silicone oil is a fluid that is used in electrophotographic fusing systems as a toner release agent. Amino silicone oil and octamethylcyclotetrasiloxane are fully miscible, and combine to form a temporally stable mixture.

For example, a 1% by volume mixture of amino silicone oil in D4 was created and tested in a handing inking experiment. A thin layer of the D4 and amino silicone oil mixture was metered onto a VITON Silicon (VOS) imaging surface using an anilox metering roll. The applied fountain solution was allowed to evaporate at room temperature for 15 minutes. Over that time period, the D4 component of the fountain solution film evaporated, leaving a thin layer of amino silicone oil. An observed gloss differential between a region originally coated with fountain solution and uncoated regions confirmed the existence of a residual silocone oil layer. The entire VOS sample was then inked with an ink useful in digital printing using a hand inking proofing system that incorporated an anilox inking roll. The deposited ink was transferred to paper under pressure using a conformable back-up roll. Then, a second transfer to paper was performed using a clean sheet of paper to determine an amount of residual ink remaining after the first transfer to paper.

Figure 3A:
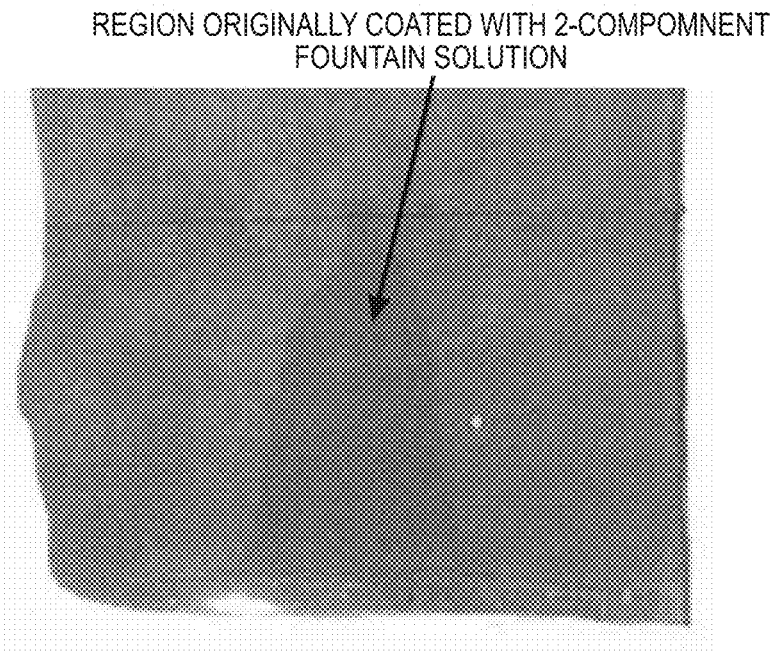
FIG. 3A shows an image of a digital ink print on paper.
Figure 3B:
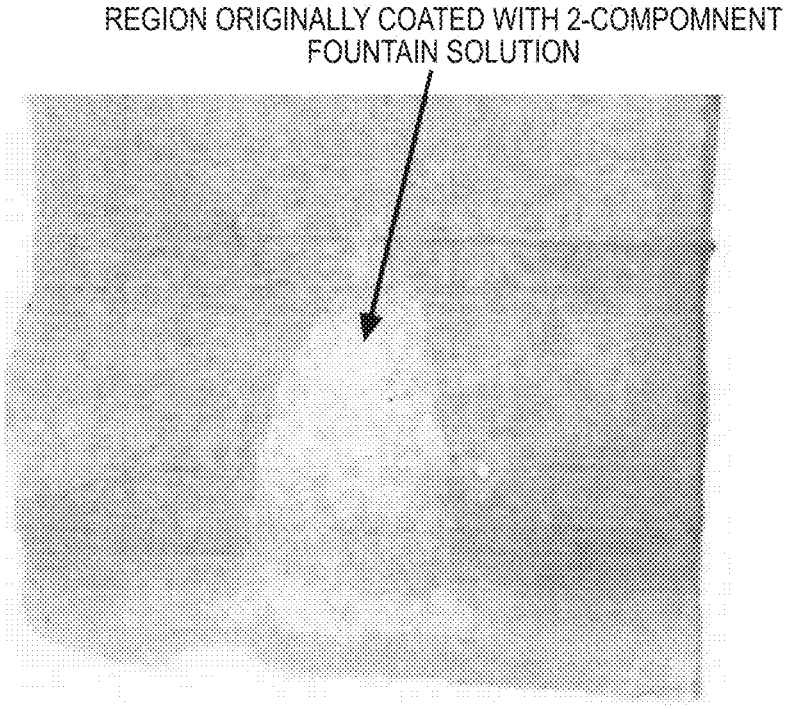
FIG. 3B shows an image of a digital ink print on paper.

FIG. 3A shows a digital image of a print from the first transfer to paper. FIG. 3A shows that an ink density was greater where fountain was originally applied. FIG. 3B shows an image of the second transfer to paper, and shows less residual ink, or lower ink density, in a region where fountain solution was originally applied. Accordingly, it has been found that the silicone layer on the VOS sample that remained after the primary components of the fountain solution evaporated enhanced ink release leading to enhanced ink image transfer efficiency.

Figure 4:
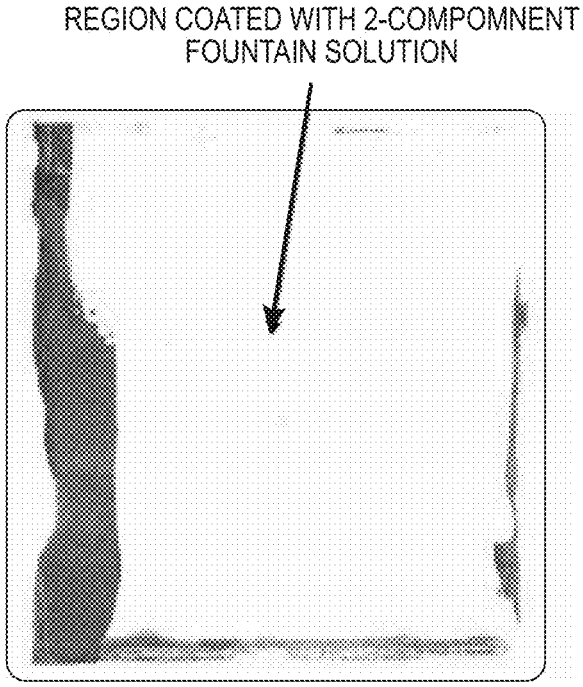
FIG. 4 shows an image of a digital ink print on paper resulting from an ink rejection test.

In another example, the VOS sample was cleaned, and a new layer of two component fountain solution was applies to the VOS sample surface. Immediately after the application of the fountain solution, the sample was inked using a hand inking unit. The results, shown in the image of FIG. 4, indicated that a D4/amino silicone oil mixture is effective for rejecting ink and enabling efficient image transfer in an imaging step while producing a print having reduced image quality defects. FIG. 4 shows a test print having a region that was coated with multi-component fountain solution.

Release agents applied by way of a multi-component fountain solution is advantageous for printing using an ink-based digital printing system over in situ approaches. The multi-component fountain solution overcomes difficulties associated with incorporating release fluid into a bulk of an imaging plate of an imaging member. An imaging plate with an in situ release fluid typically has a finite life based on an amount of release fluid incorporated into the material's bulk at manufacture. A multi-component fountain solution system may be configured to provide continued release agent over a longer imaging plate period of operability. Further, multi-component fountain solutions and systems accommodate decreased image quality defects that result from non-uniform release agent distribution. A multi-component system may apply a uniform release agent film independent of imaging plate age.

It will be appreciated that the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A method of ink-based digital printing, comprising:

applying fountain solution to a surface of an imaging plate, the fountain solution comprising ink rejecting primary components and release agent secondary components; and exposing the surface of the imaging plate by laser imaging whereby the primary components are removed from portions of the surface of the imaging plate according to imaging data, leaving a layer of secondary components on a surface of the imaging plate wherein the primary components comprise octamethylcyclotetrasiloxane.

2. The method of claim 1, comprising:

applying ink to the surface of the imaging plate to form an ink image, the ink being rejected by the primary components at portions of the surface of the imaging plate having the primary components after the exposing.

3. The method of claim 1, comprising:

transferring the ink image to a printable substrate, whereby the layer comprised of secondary components splits.

4. The method of claim 1, the secondary components comprise amino silicone oil.

5. The method of claim 1, the fountain solution comprising a 0.1% to 1% by volume mixture of amino silicone oil to octamethylcyclotetrasiloxane.

6. The method of claim 1, the ink being useful for digital printing.

7. The method of claim 1, the exposing comprising vaporizing the primary components to remove the primary component from the portions of the surface of the imaging plate according to the image data.

8. The method of claim 1, comprising:

mixing octamethylcyclotetrasiloxane and amino silicone oil to produce the fountain solution.

9. A fountain solution useful for ink-based digital printing, comprising:

primary components, wherein the primary components comprises octamethylcyclotetrasiloxane; and secondary components, the primary components having a lower boiling point than the secondary components.

10. The solution of claim 9, wherein the secondary components comprises amino silicone oil.

11. The solution of claim 10, wherein the primary components and the secondary components are miscible, the secondary components being in an amount of 0.1% to 10% by volume of the fountain solution comprising the primary components and the secondary components.

* * * * *